US010907865B2

(12) United States Patent
Baker et al.

(10) Patent No.: US 10,907,865 B2
(45) Date of Patent: Feb. 2, 2021

(54) HEATING AND COOLING SYSTEM, AND HEAT EXCHANGER FOR THE SAME

(71) Applicant: Modine Manufacturing Company, Racine, WI (US)

(72) Inventors: George Baker, Waterford, WI (US); Gregory Kohler, Waterford, WI (US); Jacob Pachniak, Mt. Pleasant, WI (US); Mark Johnson, Racine, WI (US)

(73) Assignee: MODINE MANUFACTURING COMPANY, Racine, WI (US)

( * ) Notice: Subject to any disclaimer, the term of this patent is extended or adjusted under 35 U.S.C. 154(b) by 80 days.

(21) Appl. No.: 16/080,146

(22) PCT Filed: Mar. 3, 2017

(86) PCT No.: PCT/US2017/020577
§ 371 (c)(1),
(2) Date: Aug. 27, 2018

(87) PCT Pub. No.: WO2017/152002
PCT Pub. Date: Sep. 8, 2017

(65) Prior Publication Data

US 2019/0049157 A1 Feb. 14, 2019

Related U.S. Application Data

(60) Provisional application No. 62/303,433, filed on Mar. 4, 2016.

(51) Int. Cl.
*F25B 13/00* (2006.01)
*F25B 41/04* (2006.01)
(Continued)

(52) U.S. Cl.
CPC ..... *F25B 13/00* (2013.01); *F25B 39/00* (2013.01); *F25B 41/003* (2013.01); *F25B 41/04* (2013.01);
(Continued)

(58) Field of Classification Search
CPC ..... F25B 13/00; F25B 41/04; F25B 41/046; F25B 41/003; F25B 39/00;
(Continued)

(56) References Cited

U.S. PATENT DOCUMENTS 5,165,254 A 11/1992 Kountz et al.
5,964,099 A * 10/1999 Kim ..... F25B 13/00 62/324.6
(Continued)

FOREIGN PATENT DOCUMENTS

DE 19719252 A1 11/1998
EP 250676 A1 9/2012
(Continued)

OTHER PUBLICATIONS

Partial Supplementary Search Report for European Application No. 177608684, European Patent Office dated Oct. 1, 2019 (13 pages).
(Continued)

*Primary Examiner* — Steve S Tanenbaum
(74) *Attorney, Agent, or Firm* — Michael Best & Friedrich; Jeroen Valensa; Michael Bergnach

(57) ABSTRACT

A heating and cooling system includes a heat exchange section to transfer heat between refrigerant and air in both a heating mode and a cooling mode. The heat exchange section includes at least two refrigerant passes. Refrigerant is circuited through the refrigerant passes in the same direction in both the heating mode and the cooling mode, so that the overall flow orientation between the refrigerant
(Continued)

passes and the air is a counter-flow orientation in both the heating mode and the cooling mode.

20 Claims, 3 Drawing Sheets

(51) Int. Cl.

| | |
|---|---|
| ***F28D 1/00*** | (2006.01) |
| ***F28F 27/00*** | (2006.01) |
| ***F28D 1/02*** | (2006.01) |
| ***F25B 39/00*** | (2006.01) |
| ***F25B 41/00*** | (2006.01) |
| ***F28D 21/00*** | (2006.01) |

(52) U.S. Cl.
CPC ..... *F25B 41/046* (2013.01); *F28D 1/00* (2013.01); *F28D 1/0233* (2013.01); *F28F 27/00* (2013.01); *F25B 2313/0272* (2013.01); *F25B 2313/02741* (2013.01); *F28D 2021/0068* (2013.01)

(58) Field of Classification Search
CPC .... F25B 2313/0272; F25B 2313/02741; F28D 1/0233; F28D 1/00; F28D 2021/0068; F28F 27/00
USPC ..... 62/324.6
See application file for complete search history.

(56) References Cited

U.S. PATENT DOCUMENTS

| | | | | |
|---|---|---|---|---|
| 8,113,270 | B2 | 2/2012 | Rios et al. | |
| 8,235,101 | B2 | 8/2012 | Taras et al. | |
| 2012/0103581 | A1* | 5/2012 | Seo ..... | F28F 9/0224 165/173 |
| 2015/0260437 | A1 | 9/2015 | Leman et al. | |

FOREIGN PATENT DOCUMENTS

| | | | |
|---|---|---|---|
| EP | 2990752 | A1 | 3/2016 |
| JP | H0331640 | A | 2/1991 |
| JP | H10252908 | A | 9/1998 |
| WO | 2013184522 | A1 | 12/2013 |

OTHER PUBLICATIONS

Extended Search Report for European Application No. 17760868.4, European Patent Office dated Jan. 27, 2020 (14 pages).
First Office Action for Chinese Patent Application No. 201780014929.1, China National Intellectual Property Administration dated Mar. 9, 2020 (10 pages).

* cited by examiner

HEATING MODE

COOLING MODE

HEATING AND COOLING SYSTEM, AND HEAT EXCHANGER FOR THE SAME

CROSS-REFERENCE TO RELATED APPLICATIONS

This application claims priority to U.S. Provisional Patent Application No. 62/303,433 filed Mar. 4, 2016, the entire contents of which are hereby incorporated by reference herein.

BACKGROUND

Vapor compression systems are commonly used for refrigeration and/or air conditioning and/or heating, among other uses. In a typical vapor compression system, a refrigerant, sometimes referred to as a working fluid, is circulated through a continuous thermodynamic cycle in order to transfer heat energy to or from a temperature and/or humidity controlled environment and from or to an uncontrolled ambient environment. While such vapor compression systems can vary in their implementation, they most often include at least one heat exchanger operating as an evaporator, and at least one other heat exchanger operating as a condenser.

In systems of the aforementioned kind, a refrigerant typically enters an evaporator at a thermodynamic state (i.e., a pressure and enthalpy condition) in which it is a subcooled liquid or a partially vaporized two-phase fluid of relatively low vapor quality. Thermal energy is directed into the refrigerant as it travels through the evaporator, so that the refrigerant exits the evaporator as either a partially vaporized two-phase fluid of relatively high vapor quality or a superheated vapor.

At another point in the system the refrigerant enters a condenser as a superheated vapor, typically at a higher pressure than the operating pressure of the evaporator. Thermal energy is rejected from the refrigerant as it travels through the condenser, so that the refrigerant exits the condenser in an at least partially condensed condition. Most often the refrigerant exits the condenser as a fully condensed, subcooled liquid.

Some vapor compression systems are reversing heat pump systems, capable of operating in either a cooling mode (such as when the temperature of the uncontrolled ambient environment is greater than the desired temperature of the controlled environment) or a heating mode (such as when the temperature of the uncontrolled ambient environment is less than the desired temperature of the controlled environment). Such a system may require heat exchangers that are capable of operating as an evaporator in one mode and as a condenser in another mode.

In some systems as are described above, the competing requirements of a condensing heat exchanger and an evaporating heat exchanger may result in difficulties when one heat exchanger needs to operate efficiently in both modes. One solution to these difficulties, presented in United States Patent Application Publication no. 2013/0306272A1 to Johnson et al., includes the use of a two-pass refrigerant-to-air heat exchanger incorporated within a reversing heat pump heating and cooling system. While the system is operating in one of the two modes (e.g. either the heating mode or the cooling mode) the flow through the two refrigerant passes of the heat exchanger is in counter-flow orientation to the flow of air being heated or cooled, resulting in greater heat exchange efficiency and, consequently, enhanced overall system efficiency. However, when the system operates in the other of the two modes, the direction of refrigerant flow through the heat exchanger is reversed, resulting in reduced heat exchange efficiency and, consequently, reduced overall system efficiency. Thus there is still room for improvement.

SUMMARY

According to an embodiment of the invention, a heating and cooling system for exchanging heat between a flow of refrigerant and a flow of air operates in a heating mode by transferring heat from the refrigerant to the air and operates in a cooling mode by transferring heat from the air to the refrigerant. The system includes a first plurality of fluid conduits to transport the flow of refrigerant through a heat transfer section of the heating and cooling system, and a second plurality of fluid conduits arranged downstream of the first plurality with respect to the flow of refrigerant in both the heating and the cooling mode. The flow of air passes through the heat transfer section to exchange heat with the flow of refrigerant as it passes through the first and second pluralities of fluid conduits, with the second plurality of fluid conduits being arranged upstream of the first plurality of fluid conduits with respect to the flow of air in both the heating and the cooling mode. An inlet manifold is joined to open ends of the first plurality of fluid conduits to deliver the flow of refrigerant thereto, and a collection manifold is joined to open ends of the second plurality of fluid conduits to receive the flow of refrigerant therefrom. The system further includes a compressor operable to produce a flow of hot, high-pressure refrigerant, and an expansion device operable to produce a flow of cold, low-pressure refrigerant. The inlet manifold is operatively connected to the compressor to receive refrigerant from the compressor when the system is operating in the heating mode and is operatively connected to the expansion device to receive refrigerant from the expansion device when the system is operating in the cooling mode. The collection manifold is operatively connected to the compressor to deliver refrigerant to the compressor when the system is operating in the cooling mode and is operatively connected to the expansion device to deliver refrigerant to the expansion device when the system is operating in the heating mode.

By "operatively connected", what is meant is that the indicated components are connected by piping or linework or the like, so that a fluid is able to pass from one of the components to the other without the system substantially operating on the fluid between the two components to change its thermodynamic state. Components of the system can thus be operatively connected to one another even though they are separated by some distance, and even though other components such as valves and the like are located between them.

In some embodiments, the system further includes a first, second, third, and fourth flow control device. The first flow control device is operable to allow the flow of refrigerant between the inlet manifold and the compressor when the system is operating in the heating mode, and is operable to prevent the flow of refrigerant between the inlet manifold and the compressor when the system is operating in the cooling mode. The second flow control device is operable to allow the flow of refrigerant between the inlet manifold and the expansion device when the system is operating in the cooling mode, and is operable to prevent the flow of refrigerant between the inlet manifold and the expansion device when the system is operating in the heating mode. The third flow control device is operable to allow the flow of refrigerant between the collection manifold and the expansion device when the system is operating in the heating mode, and is operable to prevent the flow of refrigerant between the collection manifold and the expansion device when the system is operating in the cooling mode. The fourth flow control device is operable to allow the flow of refrigerant between the collection manifold and the compressor when the system is operating in the cooling mode, and is operable to prevent the flow of refrigerant between the collection manifold and the compressor when the system is operating in the heating mode.

Such a flow control device can, in some embodiments, be provided as a passive flow control device. A passive flow control device is a device that has a mechanical mode of operation which is directly in response to a pressure differential acting upon the device, such as for example a check valve. When a pressure differential above a given threshold is applied to such a device in one direction, the active element of the valve is displaced from the valve seat and fluid flow is allowed in the direction of the pressure differential. However, the active element is not displaced form the valve seat when the pressure differential is below the threshold or when the pressure differential is in the opposing direction, so that flow through the control device is prevented. In still other embodiments, such a flow control device can be provided as an actively controlled device. In such a device, the fluid pressure differential is measured by a pressure sensor, and an electronic or other signal is directed to the flow control device to open or close the valve in response to the magnitude and direction of the measured pressure differential. In some embodiments a combination of active and passive flow control devices can be used.

In some embodiments the system includes a reversing valve. A first port of the reversing valve is operatively connected to an inlet of the compressor. A second port of the reversing valve is operatively connected to an outlet of the compressor. The reversing valve provides an internal fluid flow path between the first port and a third port of the reversing valve when the system is operating in the cooling mode and between the second port and the third port when the system is operating in the heating mode. A refrigerant circuit extends between the expansion device and the third port of the reversing valve, and the first and second pluralities of fluid conduits are arranged along the refrigerant circuit.

In some such embodiments the refrigerant circuit includes a first branch point and a second branch point. A first portion of the refrigerant circuit extends between the expansion device and the first branch point. A second portion of the refrigerant circuit extends between the second branch point and the third port of the reversing valve. A third portion of the refrigerant circuit extends between the first branch point and the second branch point, and includes a first branch extending between the first and second branch points and a second branch extending between the first and second branch points. The second branch is partially coextensive with the first branch. In some embodiments the first and second pluralities of fluid conduits are arranged along the coextensive parts of the branches.

In some embodiments the refrigerant flows through the first branch when the system is operating in the cooling mode and through the second branch when the system is operating in the heating mode. In some embodiments the system includes a first flow control device located along the first branch between the first branch point and the inlet manifold, a second flow control device located along the first branch between the second branch point and the collection manifold, a third flow control device located along the second branch between the second branch point and the inlet manifold, and a fourth flow control device located along the second branch between the first branch point and the collection manifold.

In some such embodiments the first flow control device allows refrigerant to flow through it when the pressure differential between the first branch point and the inlet manifold is positive and blocks refrigerant flow through it when that pressure is negative. The second flow control device allows refrigerant to flow through it when the pressure differential between the collection manifold and the second branch point is positive and blocks refrigerant through it when that pressure is negative. The third flow control device allows refrigerant to flow through it when the pressure differential between the second branch point and the inlet manifold and is positive and blocks refrigerant through it when that pressure is negative. The fourth flow control device allows refrigerant to flow through it when the pressure differential between the collection manifold and the first branch point is positive and blocks refrigerant through it when that pressure is negative.

In some embodiments the inlet manifold includes a first refrigerant port to receive a flow of cooled, low-pressure refrigerant from the expansion device when the system is operating in the cooling mode, and a second refrigerant port to receive a flow of heated, high-pressure refrigerant from the compressor when the system is operating in the heating mode.

According to another embodiment of the invention, a heat exchanger for use in a heating and cooling system includes an inlet manifold extending longitudinally from a first end to a second end, a collection manifold extending longitudinally from a first end to a second end parallel to the inlet manifold, a first plurality of flat tubes defining a first refrigerant pass of the heat exchanger, and a second plurality of flat tubes defining a second refrigerant pass of the heat exchanger. An open end of each one of the first plurality of flat tubes is joined to the inlet manifold to receive a flow of refrigerant therefrom. An open end of each one of the second plurality of flat tubes is joined to the collection manifold to deliver the flow of refrigerant thereto. A first fluid inlet port is arranged at the first or second end of the inlet manifold. A fluid distribution tube is arranged within the inlet manifold and is connected to the first fluid inlet port to receive refrigerant flow from the first fluid inlet port and to distribute it to the first plurality of flat tubes when the system is operating in a cooling mode. A second fluid inlet port is connected to the inlet manifold to deliver refrigerant flow to the inlet manifold when the system is operating in a heating mode.

In some alternative embodiments, the first fluid inlet port is arranged at a position along the inlet manifold other than at the first or second end. For example, the first fluid inlet port can be located at an intermediate position between the first and second ends.

In some embodiments the heat exchanger includes a header structure arranged at an end of the heat exchanger opposite the inlet manifold and collection manifold. The header structure receives an open end of each one of the first and second pluralities of tubes, and provides fluid connections between the first refrigerant pass and the second refrigerant pass.

The header structure arranged at the end of the heat exchanger opposite the inlet and collection manifold can, by way of example, be a flat header structure. Such a flat header structure can be constructed of two or more relatively flat metal plates that are joined together, with domed portions arranged in one or more of the relatively flat metal plates. The open ends of the first and second pluralities of tubes can be received in slots within the domed portions, and a fluid channels can be provided within the domes portions in order to convey the fluid between the open end of a tube in the first plurality of tubes and the open end of a corresponding tube in the second plurality of tubes.

In some embodiments the heat exchanger includes a fluid outlet port coupled to the collection manifold to remove the flow of refrigerant from the heat exchanger. In some such embodiments the fluid outlet port is arranged at the first or second end of the collection manifold. In other embodiments the fluid outlet port is arranged at a location along the collection manifold other than at the first or second end of the collection manifold, such as at an intermediate location between the first and second end.

In some embodiments the heat exchanger includes an outlet manifold extending longitudinally from a first end to a second end, parallel and adjacent to the collection manifold. At least one fluid conduit extends from the collection manifold to the outlet manifold. The fluid outlet port is coupled to the outlet manifold to remove the flow of refrigerant from the heat exchanger, rather than being directly coupled to the collection manifold. In some such embodiments the fluid outlet port is arranged at the first or second end of the outlet manifold. In other such embodiments, the fluid outlet port is arranged at a location along the outlet manifold other than at the first or second end of the collection manifold, such as at a location between the first and second end.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1A:
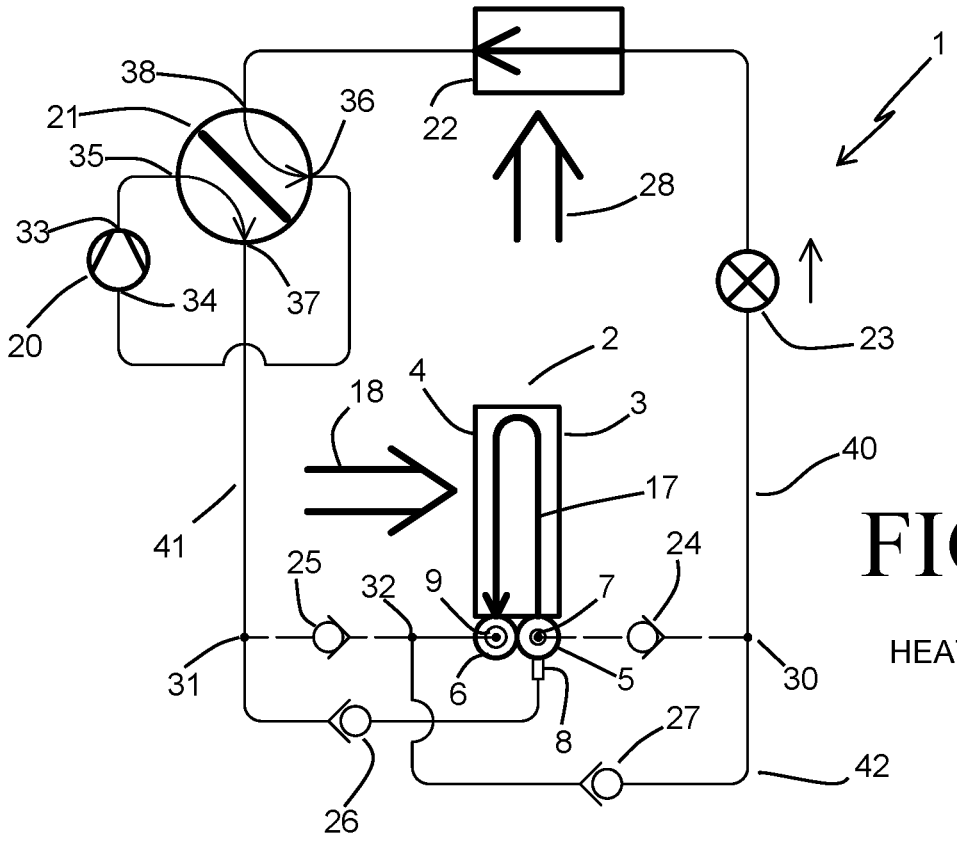
FIG. 1A is a schematic diagram of a heating and cooling system according to an embodiment of the invention, operating in a heating mode.
Figure 1B:
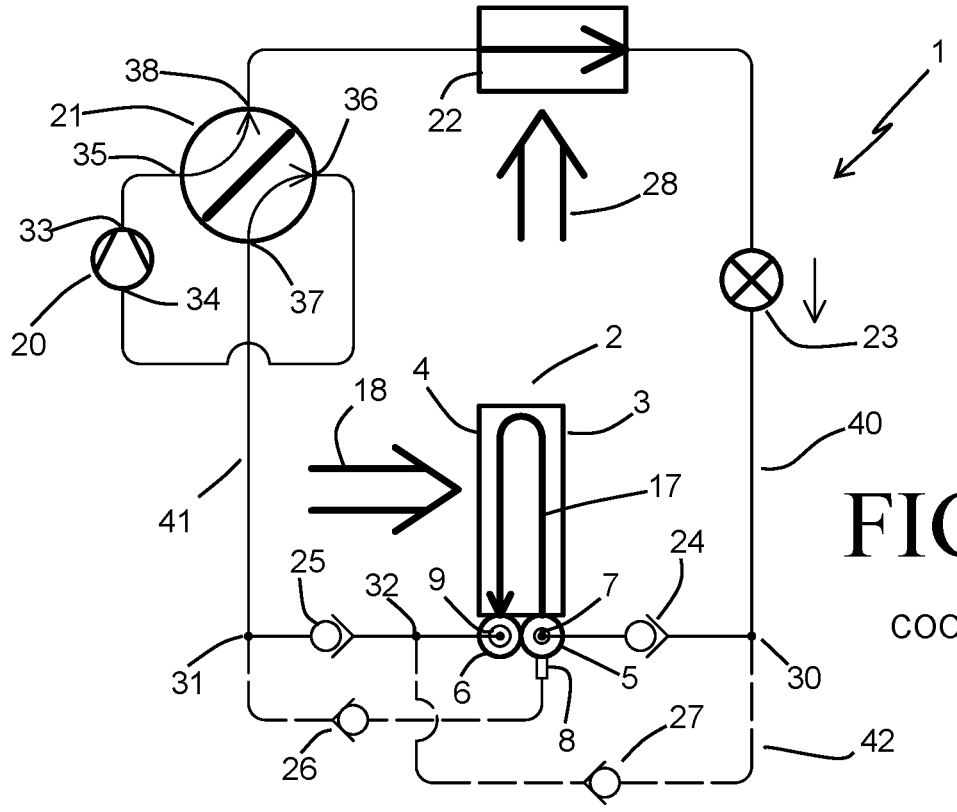
FIG. 1B is a schematic diagram of the heating and cooling system of FIG. 1A, operating in a cooling mode.

FIGS. 1A and 1B depict, in schematic fashion, a heating and cooling system 1 according to an embodiment of the present invention. The heating and cooling system 1 operates using a vapor compression cycle to heat or cool a flow of air 18. Such a system can be especially useful in controlling the temperature and/or the humidity of an occupied space by delivering the conditioned flow of air 18 to that space. In some, but not all, cases the flow of air 18 can be drawn from the conditioned space, heated or cooled within the system 1, and then returned to the conditioned space. The system 1 is capable of operating in a first mode (a heating mode) when the temperature of the conditioned space is below a desired temperature, and in a second mode (a cooling mode) when the temperature of the conditioned space is above a desired temperature. It may additionally be desired to operate the system 1 in the cooling mode when the humidity of the conditioned space exceeds a desirable level, in which case the temperature of the flow of air 18 can be reduced to be below the dew point, thus causing humidity to be removed from the flow of air 18.

The system 1 operates by circulating a flow of refrigerant along a continuous refrigerant circuit. A compressor 20 and an expansion device 23 operate to divide the refrigerant circuit into a high pressure portion between an outlet 33 of the compressor 20 and the expansion device 23, and a low pressure portion between the expansion device 23 and an inlet 34 of the compressor 21. A heat exchanger 2 is provided within a heat transfer section of the system 1 to exchange heat between the flow of air 18 and the flow of refrigerant. Another heat exchanger 22 is also provided within the system 1 to exchange heat between the refrigerant and a thermal reservoir 28. A reversing valve 21 is provided to cause the system 1 to alternate between the two modes of operation by either placing the heat exchanger 2 along the high pressure portion of the refrigerant circuit and the heat exchanger 22 along the low pressure portion, or vice versa.

The transfer of heat between the refrigerant and the thermal reservoir 28 can either be direct, as depicted in FIGS. 1A and 1B, or indirect. By way of example, direct heat transfer is accomplished when the thermal reservoir 28 is the ambient uncontrolled environment and the heat exchanger 22 is situated so that ambient air is circulated through the heat exchanger 22. By way of another example, indirect heat transfer is accomplished when the thermal reservoir 28 is the ground or a body of water, and an intermediate fluid is circulated between the thermal reservoir 28 and the heat exchanger 22.

The reversing valve 21 includes a first port 35 that is fluidly coupled to the outlet 33 of the compressor 20 to receive high pressure refrigerant from the compressor. The term "fluidly coupled", as used herein, should be understood to mean that the two points of the system are connected using piping or linework or the like so that a fluid pathway is created between them, and can alternatively be referred to as being "operatively connected". A second port 36 of the reversing valve 21 is likewise fluidly coupled to the inlet port 34 of the compressor to deliver low pressure refrigerant to the compressor. Additional ports 37 and 38 are also provided on the reversing valve 21 to provide the further connections to the refrigerant circuit.

A portion of the refrigerant circuit extends between the expansion valve 23 and the port 38 of the reversing valve 21. The heat exchanger 22 is arranged along that portion of the refrigerant circuit, so that refrigerant flowing between the expansion valve 23 and the port 38 passes through the heat exchanger 22 to exchange heat with the thermal reservoir 28. When the system 1 is operating in the heating mode, that portion of the refrigerant circuit is a part of the low pressure portion of the circuit. When the system 1 is operating in the cooling mode, that portion of the refrigerant circuit is a part of the high pressure portion of the circuit.

Another portion of the refrigerant circuit extends between the expansion valve 23 and the port 37 of the reversing valve 21. The heat exchanger 2 is arranged along that portion of the refrigerant circuit, so that refrigerant flowing between the expansion valve 23 and the port 37 passes through the heat exchanger 2 to exchange heat with the flow of air 18. When the system 1 is operating in the heating mode, that portion of the refrigerant circuit is a part of the high pressure portion of the circuit. When the system 1 is operating in the cooling mode, that portion of the refrigerant circuit is a part of the low pressure portion of the circuit.

When the system 1 is operating in a heating mode, as depicted in FIG. 1A, the reversing valve 21 is set so that refrigerant is able to flow within the valve 21 between the ports 36 and 38 and between the ports 35 and 37. Hot, high-pressure vapor phase refrigerant that has been compressed by the compressor 33 is thus directed through that section of the refrigerant circuit containing the heat exchanger 2, wherein the refrigerant is cooled and condensed by the transfer of heat to the flow of air 18, before being delivered to the expansion device 23. The cooled and condensed refrigerant is expanded within the expansion device 23 from the high pressure to a low pressure, and is thus delivered to the heat exchanger 22 as a two-phase (liquid and vapor) flow at a temperature that is below the temperature of the thermal reservoir 28. The transfer of heat to the flow of refrigerant within the heat exchanger 22 evaporates and, preferably, partially superheats the refrigerant. The superheated refrigerant is then returned to the compressor 20 by way of the reversing valve 21 to be compressed and recirculated through the system 1.

When the system 1 is operating in a cooling mode, as depicted in FIG. 1B, the reversing valve 21 is set so that refrigerant is able to flow within the valve 21 between the ports 35 and 38 and between the ports 36 and 37. Hot, high-pressure vapor phase refrigerant that has been compressed by the compressor 33 is thus directed through that section of the refrigerant circuit containing the heat exchanger 22, wherein the refrigerant is cooled and condensed by the transfer of heat to the thermal reservoir 28, before being expanded in the expansion device 23. In this operating mode, the two-phase refrigerant exiting the expansion device 23 is directed through the heat exchanger 2 as a cold, low-pressure refrigerant at a temperature that is below the temperature of the flow of air 18, and is evaporated and slightly superheated by the transfer of heat from the flow of air 18 before being returned to the compressor 20 by way of the reversing valve 21.

In order to achieve greater heat transfer efficiency within the heat exchanger 2, the refrigerant passes through the heat exchanger 2 along a fluid flow path 17 that includes at least two successive passes through the heat exchanger 2. In both the heating mode and the cooling mode, the successive passes along the fluid flow path 17 are arranged in a counter-flow orientation to the flow of air through the heat exchanger 2. The heat exchanger 2 has an air inlet face 4 located at an upstream end of the heat exchanger 2 along the air flow path to receive the flow of air 18 into the heat exchanger 2, and an air exit face 3 located at the opposite, downstream end of the air flow path. A first pass along the fluid flow path 17 is located closest to the air outlet face 3, while a final pass along the fluid flow path 17 is located closest to the air inlet face 4.

Figure 2:
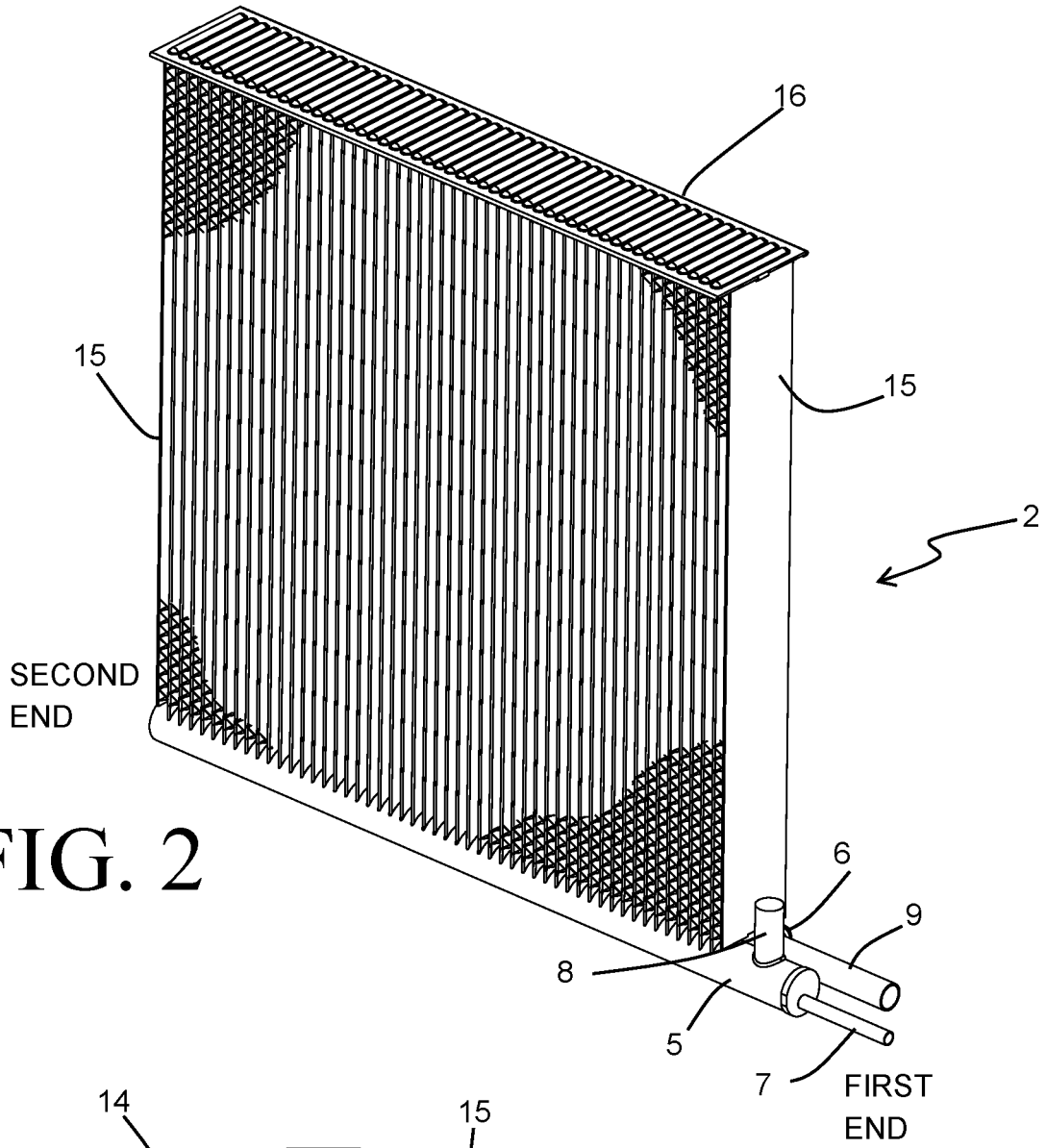
FIG. 2 is a perspective view of a heat exchanger according to an embodiment of the present invention.
Figure 3:
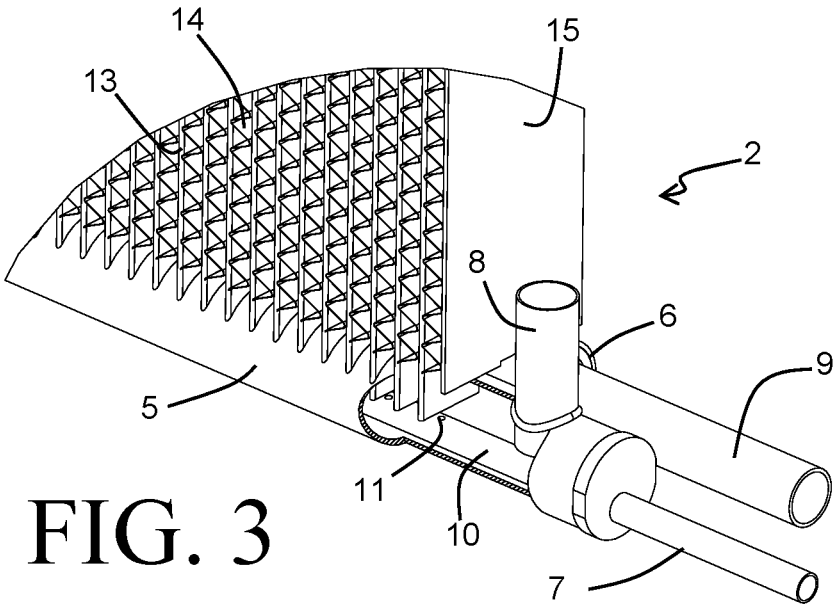
FIG. 3 is a partially cut-away perspective view of a portion of the heat exchanger of FIG. 2.

An especially preferable embodiment of the heat exchanger 2 is depicted in FIGS. 2-3, and has many elements in common with a heat exchanger disclosed in U.S. Pat. No. 8,776,873 to Mross et al., the entire contents of which are incorporated by reference herein. The heat exchanger 2 includes an inlet manifold 5 and a plurality of flat tubes 13 arranged in a row, with open ends of the flat tubes 13 joined to the inlet manifold. The inlet manifold 5 is of a tubular construction and extends longitudinally from a first end to a second end, with slots arranged along the longitudinal length to receive the ends of the flat tubes 13. A collection manifold 6 is provided adjacent to the inlet manifold 5, is also of a tubular construction, and extends longitudinally from a first end to a second end parallel to the inlet manifold 5. A second plurality of flat tubes 13 are arranged in a second row in one-to-one correspondence with the flat tubes 13 of the first row, and open ends of the flat tubes 13 of the second row are joined to the collection manifold.

A return header 16 is provided at the end of the heat exchanger 2 opposite the inlet manifold 5 and the collection manifold 6. Open ends of the flat tubes 13 of both the first and the second rows are received into the return header 16, and the return header 16 provides fluid connections between the flat tubes 13 of the first row and the flat tubes 13 of the second row. In this manner, the flat tubes 13 of the first row provide fluid conduits to define a first pass of the fluid flow path 17 through the heat exchanger 2, and the flat tubes 13 of the second row provide fluid conduits for the second pass of the fluid flow path 17.

Corrugated fin structures 14 are provided between adjacent flat tubes in each of the rows, and crests and troughs of the fin structures 14 are bonded to the flat surfaces of the tubes 13. The corrugated fin structures 14 provide enhanced heat transfer surfaces for the flow of air 18 as it passes through the heat exchanger 2, and enable the efficient transfer of heat between the air and the flow of refrigerant traveling through the flat tubes 13. Separate fin structures 14 can be provided for each of the two rows of flat tubes, but more preferably the corrugated fin structures have a depth that is sufficient to span both rows of tubes. Side plates 15 are provided at either end of the heat exchanger 2 to bound the heat exchange core, and the entire heat exchanger 2 (including the manifolds 5 and 6, the flat tubes 13, the corrugated fin structures 14, the return header 16, and the side plates 15) can be joined together in a brazing operation.

Two separate inlets to allow for the flow of refrigerant into the inlet manifold are further provided as part of the heat exchanger 2. As best seen in the partial view of FIG. 3, a first inlet port 7 is provided at the first end of the inlet manifold. A fluid distribution tube 10 extends at least part way along the longitudinal length of the inlet manifold, and is joined to the first inlet port 7 to receive the flow of refrigerant therefrom. Alternatively, instead of the first inlet port 7 being joined to the fluid distribution tube 10, the fluid distribution tube 10 can be extended to terminate at a location outside of the inlet manifold 5 and the first inlet port 7 can be provided integrally with the fluid distribution tube 10 at the end thereof.

Within the heating and cooling system 1, the first fluid inlet port 7 is connected into the refrigerant circuit to receive the two-phase refrigerant flow from the expansion device when the system is operating in cooling mode. The distribution tube 10 is provided with a series of apertures 11 through which the refrigerant can pass from the distribution tube 10 into the main chamber of the inlet manifold 5. This allows for more uniform delivery of the two-phase refrigerant flow to the flat tubes 13 of the first pass. In some embodiments the distribution tube 10 extends over the entire longitudinal length of the inlet manifold 5, while in other embodiments the distribution tube 10 extends over only a portion of the length and terminates with an open end at some intermediate location between the first end and the second end.

A second inlet port 8 is additionally provided at the first end of the inlet manifold 5, and is connected into the refrigerant circuit to receive the hot high-pressure refrigerant from the compressor 20 when the system 1 is operating in the heating mode. The length of the inlet manifold at the first end is extended some amount beyond the side plate 15 at that first end in order to more easily accommodate the inlet port 8. Alternatively, the second inlet port 8 can be located at the second end of the inlet manifold 5 (e.g. opposite from the inlet port 7) or at an intermediate location along the longitudinal length of the inlet manifold 5, in which case the extension of the inlet manifold 5 is unnecessary. The second inlet port 8 is preferably of a larger diameter than the first inlet port 7 in order to accommodate the decreased density of the fully vapor refrigerant, and it provides for a direct discharge of the refrigerant into the main chamber of the inlet manifold 5. As the fully vapor refrigerant flow from the compressor is less prone to maldistribution, it is typically not necessary for the refrigerant entering through the inlet port 8 to pass through the distribution tube 10, and the increased pressure drop associated with doing so is undesirable.

Although the inlet port 8 and the inlet port 7 are shown as being located at the same end of the inlet manifold 5, it should be understood that this is not a requirement for all embodiments. In some embodiments, it may be preferable to located the inlet port 8 at the end of the inlet manifold 5 opposite the inlet port 7. In still other embodiments it may be preferable to locate one or both of the inlet ports at a location other than at an end of the inlet manifold 5, such as at an intermediate location along the longitudinal length between the first and second ends.

An outlet port 9 is provided at the first end of the collection manifold 6, and the refrigerant that is received into the collection manifold 6 from the second row of flat tubes 13 is removed from the heat exchanger 2 through that outlet port 9. The outlet port 9 can alternatively be provided at the opposite second end of the collection manifold 6, or at an intermediate location along the longitudinal length.

The section of the refrigerant circuit extending between the port 37 of the reversing valve 21 and the expansion device 23, and which include the heat exchanger 2 for conditioning the flow of air 18, will now be explained in further detail with particular reference to FIGS. 1A and 1B. In order to allow for the counter-cross flow orientation between the refrigerant flow and the air flow 18 in both the heating mode and the cooling mode, several flow control devices are provided along that section of the refrigerant circuit. A first branch point 30 and a second branch point 31 are provided along that section of the circuit, and these branch points 30 and 31 serve to divide that section of the refrigerant circuit into a first portion 40 extending between the expansion device 23 and the branch point 30, a second portion 41 extending between the port 37 of the reversing valve 21 and the branch point 31, and a third portion 42 extending between the branch points 30 and 31, with the heat exchanger 2 being located along the third portion 42. The third portion 42 is divided into two parallel branches, both of which include the fluid flow path 17 extending through the heat exchanger 2. Refrigerant flows along one of the two parallel branches when the system 1 is operating in the cooling mode, but flow along that branch is blocked when the system 1 is operating in the heating mode. Similarly, refrigerant flows along the other of the two parallel branches when the system 1 is operating in the heating mode, but flow along that branch is blocked when the system 1 is operating in the cooling mode.

FIG. 1A depicts the system 1 operating in the heating mode. The branch along which the refrigerant flows in the heating mode is depicted using solid lines in FIG. 1A, and the branch along which the refrigerant is prevented from flowing in the heating mode is depicted using dashed lines. Hot, superheated vapor refrigerant enters the branch point 31 from the reversing valve 21 and passes along the heating branch to the inlet port 8 of the heat exchanger 2. A flow control device 26 is provided along the heating branch between the branch point 31 and the inlet port 8, and is responsive to a pressure differential between the branch point 31 and the inlet manifold 5 so as to allow for the flow of refrigerant when the refrigerant pressure at the branch point 31 exceeds the refrigerant pressure at the inlet manifold 5 (i.e. when the system 1 is operating in heating mode) and to block the flow of refrigerant when the refrigerant pressure at the branch point 31 is less than the refrigerant pressure at the inlet manifold 5 (i.e. when the system 1 is operating in cooling mode).

Another portion of the heating branch extends between the outlet port 9 of the heat exchanger 2 and the branch point 30, and the refrigerant flows along that portion of the heating branch after having passed through the heat exchanger 2 along the fluid flow path 17 and having rejected heat to the air flow 18. Another flow control device 27 is provided along that portion of the heating branch between the outlet port 9 and the branch point 30, and is responsive to a pressure differential between the collection manifold 6 and the branch point 30 so as to allow for the flow of refrigerant when the refrigerant pressure at the collection manifold 6 exceeds the refrigerant pressure at the branch point 30 (i.e. when the system 1 is operating in heating mode) and to block the flow of refrigerant when the refrigerant pressure at the collection manifold 6 is less than the refrigerant pressure at the branch point 30 (i.e. when the system 1 is operating in cooling mode).

FIG. 1B depicts the system 1 operating in the cooling mode. The branch along which the refrigerant flows in the cooling mode is depicted using solid lines in FIG. 1B, and the branch along which the refrigerant is prevented from flowing in the cooling mode is depicted using dashed lines. Cold, two-phase refrigerant enters the branch point 30 from the expansion device 23 and passes along the cooling branch to the inlet port 7 of the heat exchanger 2. A flow control device 24 is provided along the cooling branch between the branch point 30 and the inlet port 7, and is responsive to a pressure differential between the branch point 30 and the inlet manifold 5 so as to allow for the flow of refrigerant when the refrigerant pressure at the branch point 30 exceeds the refrigerant pressure at the inlet manifold 5 (i.e. when the system 1 is operating in cooling mode) and to block the flow of refrigerant when the refrigerant pressure at the branch point 30 is less than the refrigerant pressure at the inlet manifold 5 (i.e. when the system 1 is operating in heating mode).

Another portion of the cooling branch extends between the outlet port 9 of the heat exchanger 2 and the branch point 31, and the refrigerant flows along that portion of the cooling branch after having passed through the heat exchanger 2 along the fluid flow path 17 and having received heat from the air flow 18. Another flow control device 25 is provided along that portion of the cooling branch between the outlet port 9 and the branch point 31, and is responsive to a pressure differential between the collection manifold 6 and the branch point 31 so as to allow for the flow of refrigerant when the refrigerant pressure at the collection manifold 6 exceeds the refrigerant pressure at the branch point 31 (i.e. when the system 1 is operating in cooling mode) and to block the flow of refrigerant when the refrigerant pressure at the collection manifold 6 is less than the refrigerant pressure at the branch point 31 (i.e. when the system 1 is operating in heating mode).

In some especially preferable embodiments, the flow control devices 24, 25, 26, and 27 are passive flow control devices such as check valves. In other embodiments, one or more of those flow control devices can be actively controlled.

In order to allow for a single outlet port 9 to be used in both heating mode and cooling mode, an additional branch point 32 is provided along both branches of the portion 42 of the refrigerant circuit. The branch point 32 is located between the outlet port 9 and the flow control device 25, and also between the outlet port 9 and the flow control device 27. As a result, that part of the portion 42 that extends between the inlet manifold 5 and the branch point 32 is common to both the heating branch and the cooling branch. In some embodiments, separate outlet for heating mode and for cooling mode can be provided in place of the single outlet 9. In such embodiments, the branch point 32 becomes unnecessary.

Figure 4:
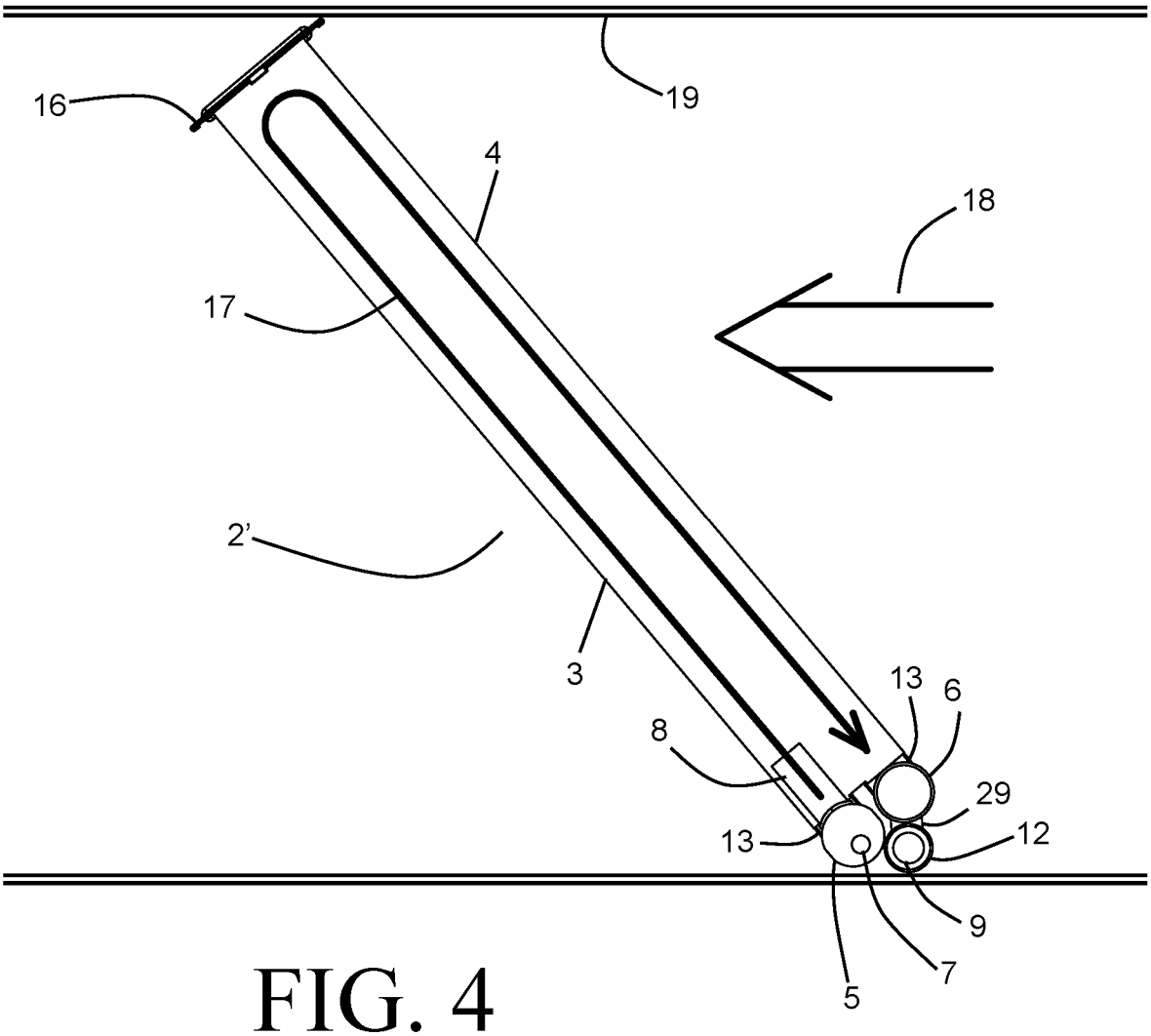
FIG. 4 is a side view of a heat exchanger installed into a heating and cooling system, according to an embodiment of the invention.

Another embodiment of a heat exchanger 2' incorporated into a heating and cooling system is shown in FIG. 4. Aspects of the heat exchanger 2' that are in common with the previously described heat exchanger 2 are numbered in like fashion in FIG. 4. The heat exchanger 2' is housed within an air plenum 19 through which the flow of air 18 is directed. The heat exchanger 2' is oriented at an oblique angle to the general flow direction of the air flow 18, allowing for a larger heat exchanger to be accommodated without requiring an increase in the cross-sectional size of the plenum 19. As a result of this arrangement, the air inlet face 4 and the air outlet face 3 are arranged at a non-perpendicular angle to the incoming flow of air 18. However, the air flow channels that are provided by the convolutions of the corrugated fin structures 14 serve to re-orient the flow of air as it passes through the heat exchanger 2', so that the previously described cross-counter flow arrangement between the refrigerant and the air is maintained.

An outlet manifold 12 that is separate from the collection manifold 6 and is arranged adjacent thereto is provided in the heat exchanger 2'. Refrigerant that is received into the collection manifold 6 from the flat tubes 13 is directed through one or more conduits 29 into the exit manifold 12. The outlet port 9 is relocated to the outlet manifold 12, and the flow of refrigerant is removed from the heat exchanger 2' through the outlet port 9. Such an arrangement can provide advantages in the performance of the heat exchanger 2' by improving the distribution of the refrigerant among the flat tubes 13, as is described in greater detail in currently pending U.S. patent application Ser. No. 13/544,027 with a filing date of Jul. 9, 2012, the contents of which are hereby incorporated by reference herein in their entirety.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. A heating and cooling system for exchanging heat between a flow of refrigerant and a flow air, the direction of heat exchange being from the refrigerant to the air when the system is operating in a heating mode and from the air to the refrigerant when the system is operating in a cooling mode, comprising:

a first plurality of fluid conduits to transport the flow of refrigerant through a heat transfer section of the heating and cooling system, the flow of air passing through the heat transfer section to exchange heat with the flow of refrigerant as it passes through the first plurality of fluid conduits;

a second plurality of fluid conduits to transport the flow of refrigerant through the heat transfer section, the second plurality of fluid conduits being arranged downstream of the first plurality of fluid conduits with respect to the flow of refrigerant when the system is operating in both the heating mode and the cooling mode, the flow of air passing through the heat transfer section to exchange heat with the flow of refrigerant as it passes through the second plurality of fluid conduits, the second plurality of fluid conduits being arranged upstream of the first plurality of fluid conduits with respect to the flow of air when the system is operating in both the heating mode and the cooling mode;

an inlet manifold joined to open ends of the first plurality of fluid conduits to deliver the flow of refrigerant thereto, the inlet manifold including two separate inlets;

a collection manifold joined to open ends of the second plurality of fluid conduits to receive the flow of refrigerant therefrom;

a compressor operable to produce a flow of hot, high-pressure refrigerant; and an expansion device operable to produce a flow of cold, low-pressure refrigerant, wherein the inlet manifold is operatively connected to the compressor to receive refrigerant from the compressor when the system is operating in the heating mode and is operatively connected to the expansion device to receive refrigerant from the expansion device when the system is operating in the cooling mode, and wherein the collection manifold is operatively connected to the compressor to deliver refrigerant to the compressor when the system is operating in the cooling mode and is operatively connected to the expansion device to deliver refrigerant to the expansion device when the system is operating in the heating mode, wherein the two separate inlets of the inlet manifold include a first refrigerant port having a first diameter and arranged between the expansion device and the first plurality of fluid conduits with respect to the flow of refrigerant when the system is in the cooling mode, and wherein the two separate inlets of the inlet manifold include a second refrigerant port having a second diameter different from the first diameter and arranged between the and the first plurality of fluid conduits with respect to the flow of refrigerant when the system is in the heating mode.

2. The heating and cooling system of claim 1, further comprising:

a first flow control device is located upstream with respect to the flow of refrigerant of the inlet manifold in the heating mode and operable to allow the flow of refrigerant between the inlet manifold and the compressor when the system is operating in the heating mode and operable to prevent the flow of refrigerant between the inlet manifold and the compressor when the system is operating in the cooling mode;

a second flow control device is located upstream with respect to the flow of refrigerant of the inlet manifold in the cooling mode and operable to allow the flow of refrigerant between the inlet manifold and the expansion device when the system is operating in the cooling mode and operable to prevent the flow of refrigerant between the inlet manifold and the expansion device when the system is operating in the heating mode;

a third flow control device operable to allow the flow of refrigerant between the collection manifold and the expansion device when the system is operating in the heating mode and operable to prevent the flow of refrigerant between the collection manifold and the expansion device when the system is operating in the cooling mode; and a fourth flow control device operable to allow the flow of refrigerant between the collection manifold and the compressor when the system is operating in the cooling mode and operable to prevent the flow of refrigerant between the collection manifold and the compressor when the system is operating in the heating mode.

3. The heating and cooling system of claim 1, further comprising:

a reversing valve having a first port operatively connected to an inlet of the compressor, a second port operatively connected to an outlet of the compressor, and a third port, wherein the reversing valve provides an internal fluid flow path between the first port and the third port when the system is operating in the cooling mode and between the second port and the third port when the system is operating in the heating mode; and a refrigerant circuit extending between the expansion device and the third port of the reversing valve, wherein the first and second pluralities of fluid conduits are arranged along the refrigerant circuit.

4. The heating and cooling system of claim 3, wherein the refrigerant circuit comprises:

a first branch point;

a second branch point;

a first portion of the refrigerant circuit extending between the expansion device and the first branch point;

a second portion of the refrigerant circuit extending between the second branch point and the third port of the reversing valve; and a third portion of the refrigerant circuit extending between the first branch point and the second branch point, the third portion including a first branch extending between the first and second branch points and a second branch extending between the first and second branch points, wherein the second branch is partially coextensive with the first branch.

5. The heating and cooling system of claim 4, wherein the first and second pluralities of fluid conduits are arranged along the coextensive parts of the first and second branches of the third portion of the refrigerant circuit, wherein the refrigerant flows through the first branch when the system is operating in the cooling mode and through the second branch when the system is operating in the heating mode.

6. The heating and cooling system of claim 5, further comprising:

a first flow control device located along the first branch between the first branch point and the inlet manifold;

a second flow control device located along the first branch between the second branch point and the collection manifold;

a third flow control device located along the second branch between the second branch point and the inlet manifold; and a fourth flow control device located along the second branch between the first branch point and the collection manifold.

7. The heating and cooling system of claim 6, wherein:

the first flow control device allows refrigerant to flow through it when the pressure differential between the first branch point and the inlet manifold is positive and blocks refrigerant flow through it when that pressure is negative;

the second flow control device allows refrigerant to flow through it when the pressure differential between the collection manifold and the second branch point is positive and blocks refrigerant flow through it when that pressure is negative;

the third flow control device allows refrigerant to flow through it when the pressure differential between the second branch point and the inlet manifold is positive and blocks refrigerant flow through it when that pressure is negative; and the fourth flow control device allows refrigerant to flow through it when the pressure differential between collection manifold and the first branch point is positive and blocks refrigerant flow through it when that pressure is negative.

8. A heat exchanger for use in a heating and cooling system, comprising:

an inlet manifold extending longitudinally from a first end to a second end, the inlet manifold including two separate inlets to convey flow of refrigerant into the inlet manifold;

a collection manifold extending longitudinally from a first end to a second end, parallel to the inlet manifold;

a first plurality of tubes defining a first refrigerant pass of the heat exchanger, an open end of each one of the first plurality of tubes joined to the inlet manifold to receive a flow of refrigerant therefrom; and a second plurality of tubes defining a second refrigerant pass of the heat exchanger, an open end of each one of the second plurality of tubes joined to the collection manifold to deliver the flow of refrigerant thereto, wherein the two separate inlets include a first fluid inlet port having a first diameter and arranged to deliver refrigerant flow to the inlet manifold when the system is operating in a cooling mode, wherein the two separate inlets include a second fluid inlet port having a second diameter and arranged to deliver refrigerant flow to the inlet manifold when the system is operating in a heating mode, and wherein the first diameter is different than the second diameter.

9. The heat exchanger of claim 8, further comprising a header structure arranged at an end of the heat exchanger opposite the inlet manifold and the collection manifold, the header structure receiving an open end of each one of the first and the second pluralities of tubes and providing fluid connections between the first refrigerant pass and the second refrigerant pass.

10. The heat exchanger of claim 8, wherein the first fluid inlet port is arranged at one of the first and second ends of the inlet manifold.

11. The heat exchanger of claim 8, wherein the second diameter is greater than the first diameter.

12. The heat exchanger of claim 8, further comprising a side plate located at an end of the heat exchanger, wherein the inlet manifold extends in an axial direction of the inlet manifold beyond the side plate and beyond the first end of the collection manifold.

13. The heat exchanger of claim 8, wherein the first fluid inlet port extends out of the inlet manifold in an axial direction of the inlet manifold and wherein the second fluid inlet port is joined to a side wall of the inlet manifold.

14. The heat exchanger of claim 8, further comprising a fluid distribution tube arranged within the inlet manifold, the fluid distribution tube receiving refrigerant flow from the first fluid inlet port and distributing that refrigerant flow to the first plurality of tubes when the system is operating in a cooling mode.

15. The heat exchanger of claim 14, wherein fluid distribution tube extends in an axial direction of the inlet manifold and extends from the first end of the inlet manifold to pass by connections to the inlet manifold of the second fluid inlet port and at least one of the first plurality of tubes.

16. The heat exchanger of claim 15, wherein the fluid distribution tube is located on one side of the inlet manifold and wherein second fluid inlet port is joined to the inlet manifold on another side of the inlet manifold radially opposite of the fluid distribution tube.

17. The heat exchanger of claim 8, further comprising a fluid outlet port joined to the collection manifold to remove the flow of refrigerant from the heat exchanger.

18. The heat exchanger of claim 17, wherein the fluid outlet port is arranged at one of the first and second ends of the collection manifold.

19. The heat exchanger of claim 8, further comprising:

an outlet manifold extending longitudinally from a first end to a second end, parallel and adjacent to the collection manifold;

at least one fluid conduit extending from the collection manifold to the outlet manifold; and a fluid outlet port joined to the outlet manifold to remove the flow of refrigerant from the heat exchanger.

20. The heat exchanger of claim 19, wherein the fluid outlet port is arranged at one of the first and second ends of the outlet manifold.

* * * * *